US007216964B2

(12) United States Patent
Holland et al.

(10) Patent No.: US 7,216,964 B2
(45) Date of Patent: May 15, 2007

(54) STRAIN RELIEF FOR INK CARTRIDGE INK SUPPLY TUBE

(75) Inventors: Carl W. Holland, Webster, NY (US); William A. Putman, Franklin, TN (US); Graham Anthony, Brooklyn, PA (US)

(73) Assignee: Nu-Kote International, Inc., Franklin, TN (US)

( * ) Notice: Subject to any disclaimer, the term of this patent is extended or adjusted under 35 U.S.C. 154(b) by 224 days.

(21) Appl. No.: 10/965,099

(22) Filed: Oct. 15, 2004

(65) Prior Publication Data

US 2006/0082623 A1 Apr. 20, 2006

(51) Int. Cl.
*B41J 2/175* (2006.01)

(52) U.S. Cl. ..... 347/87; 347/86

(58) Field of Classification Search ..... 347/86–87
See application file for complete search history.

(56) References Cited

U.S. PATENT DOCUMENTS 5,367,328 A * 11/1994 Erickson ..... 347/7
5,469,201 A 11/1995 Erickson et al.
5,745,137 A 4/1998 Scheffelin et al.
5,900,896 A * 5/1999 Barinaga et al. ..... 347/86
6,000,791 A * 12/1999 Scheffelin et al. ..... 347/87
6,003,984 A * 12/1999 Bohorquez et al. ..... 347/86
6,164,771 A * 12/2000 Eckard et al. ..... 347/86
6,511,165 B1 * 1/2003 Barinaga et al. ..... 347/85

OTHER PUBLICATIONS

International Search Report for International Application No. PCT/US05/36643.

* cited by examiner

*Primary Examiner*—Stephen Meier
*Assistant Examiner*—Han Samuel Choi
(74) *Attorney, Agent, or Firm*—Fay Sharpe LLP

(57) ABSTRACT

An ink jet cartridge for use in a continuous cartridge refill system has a top side, a front side, and a handle at the juncture therebetween. A flexible ink supply tube for connecting the cartridge with an ink reservoir extends through openings in the handle of the cartridge and is connected to a fitting on the top side of the cartridge which communicates the supply tube with the ink chamber of the cartridge. Routing of the tube through the handle provides strain relief for restraining the application of a pulling force on the tubing at the point of connection thereof with the coupling.

11 Claims, 2 Drawing Sheets

STRAIN RELIEF FOR INK CARTRIDGE INK SUPPLY TUBE

BACKGROUND OF THE INVENTION

This invention relates to the art of ink cartridges for ink jet printers and, more particularly, to arrangements for relieving the strain on an ink supply line to an ink cartridge in a continuous ink supply system.

Continuous ink refill systems for disposable ink jet cartridges are well known as shown, for example, in U.S. Pat. No. 5,469,201 to Erickson, et al. and U.S. Pat. No. 5,745,137 to Scheffelin, et al., both of which are incorporated herein by reference for background information. Basically, in such a continuous ink refill system, a cartridge is connected to an auxiliary ink supply reservoir by means of a flexible hose or tube, and during operation of the printing system, the tube is open to allow ink to flow from the auxiliary reservoir to the ink cartridge. During shipment or handling of the ink supply reservoir/cartridge system when it is outside the printer, as well as during the installation and removal of the system relative to a printer, it is important that the connection of the supply tube to the cartridge be leak tight to preclude the leakage of ink within the cartridge assembly, onto exterior surfaces of the cartridge, into a container in which the ink supply reservoir system is packaged, and/or onto surfaces within the printer. In connection with maintaining a leak tight connection for the latter purposes, it is important to optimize protection of the supply tubing from becoming disconnected from the cartridge during use and/or handling.

Heretofore, as shown for example in the aforementioned patent to Erickson, et al., the ink supply tube extends into a cartridge through an opening in a wall thereof and the tubing is bonded to the cartridge at the opening to provide strain relief against separation of the tubing from the cartridge. In the patent to Scheffelin, et al., the supply tubing is coupled to the cartridge through the cartridge handle and a slidably interengaged coupling arrangement. Neither of these arrangements secures the tubing relative to the cartridge so as to preclude the direct application of force axially of the tubing which can result in separation thereof from the cartridge and, accordingly, neither arrangement provides an adequate relief of or protection against strain on the tubing at the point of connection with the cartridge.

SUMMARY OF THE INVENTION

In accordance with the present invention, strain relief arrangements are provided for optimizing protection of the ink supply tubing from the direct application of a force tending to separate the tubing from the cartridge at the point of connection therebetween. More particularly in accordance with the invention, the tubing is routed through the handle of a cartridge so as to provide a bend in the tubing between the point of connection and the handle. The bend precludes pulling on the tubing at a point beyond the handle toward the ink supply reservoir which would be directly applied to the point of connection between the tubing and cartridge. At least partially in this respect, any such force applied to the tubing will be transferred to or imposed on the handle rather than to the tubing of the point of connection with the cartridge. The routing may provide for a second bend in the tubing relative to the handle which further restrains or precludes the application of a pulling force on the tubing at the point of connection thereof with the cartridge. Preferably, the tubing is connected in flow communication with the ink chamber of the cartridge through an L-shaped coupling mounted on the top wall of the cartridge and having a leg parallel to the top wall and extending to the cartridge handle, whereby the tubing connection to the cartridge provides a low profile which further protects against separation of the tubing from the cartridge.

It is accordingly an outstanding object of the present invention to provide improved strain relief arrangements for flexible ink supply tubing connected to an ink cartridge used in a continuous ink refill system for disposable ink cartridges.

Another object is the provision of strain relief arrangements of the foregoing character in which the flexible tubing is routed through openings in the handle of a cartridge such that pulling forces on the tubing are imposed on the handle and are restrained from being imposed on the tubing at the point of connection thereof with the cartridge.

A further object is the provision of strain relief arrangements of the foregoing character which provide a low profile with respect to the routing of the tubing from the cartridge to the openings through the handle, thus to further protect the tubing at the point of connection thereof with the cartridge.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which.

DESCRIPTION OF PREFERRED EMBODIMENTS

Figure 1:
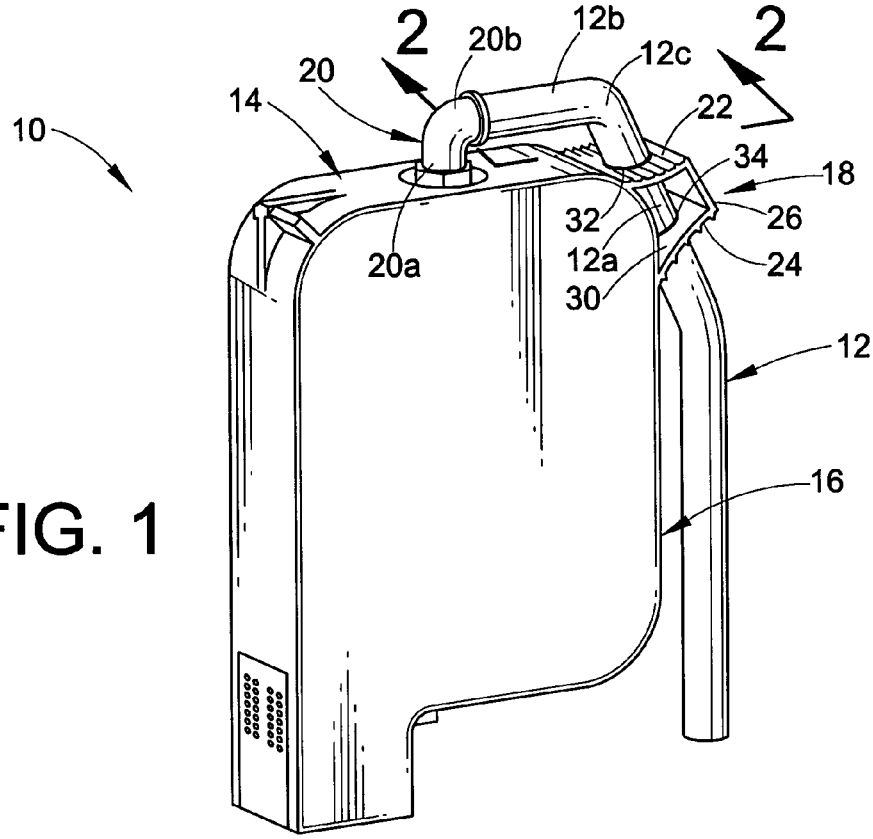
FIG. 1 is a perspective view of an ink cartridge having a strain relief arrangement according to the invention for flexible ink supply tubing connected to the cartridge.
Figure 2:
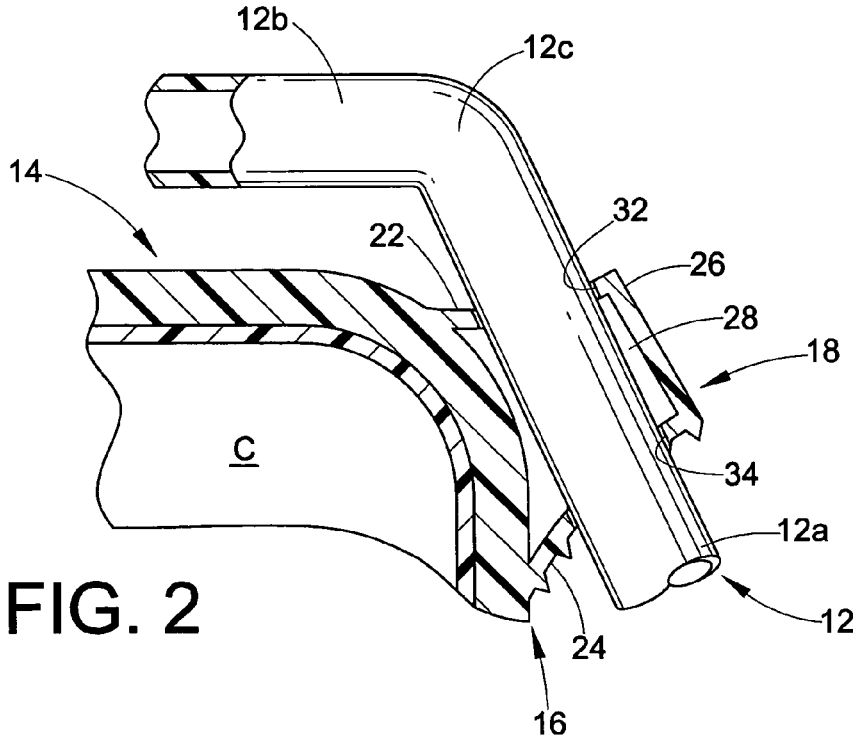
FIG. 2 is an enlarged cross-sectional view of the strain relief arrangement taken along line 2—2 in FIG. 1.

Referring now in greater detail to the drawings, wherein the showings are for the purpose of illustrating preferred embodiments of the invention only, and not for the purpose of limiting the invention, FIGS. 1 and 2 illustrate an ink cartridge 10 which is adapted to be connected to an ink reservoir, not shown, by flexible ink supply tubing 12 to provide a continuous refill system for the cartridge. Cartridge 10 includes a top side 14, a front side 16 and a handle 18 at the juncture between the top and front sides, and tubing 12 is routed through handle 18 as described more fully hereinafter and is connected to the ink chamber C of cartridge 10 through a coupling element 20. More particularly in this respect, coupling 20 has a leg 20*a* extending through top side 14 and opening into chamber C and a leg 20*b* extending parallel to top side 14 and toward handle 18.

Handle 18 includes a top wall 22, a bottom wall 24, and a front wall 26 therebetween and has laterally opposite sides, one of which is closed by a side wall 28 and the other of which is open as designated by numeral 30. Top wall 22 is provided with an opening 32 and bottom wall 24 is provided with an opening 34, which openings are generally centrally between the opposite sides of the handle, and tubing 12 includes a section 12*a* extending upwardly through openings 32 and 34 and a section 12*b* which extends inwardly from section 12*a* and has a terminal end receiving leg 20*b* of coupling element 20. This routing of tubing 12 provides a bend 12*c* between sections 12*a* and 12*b*, and the disposition of leg 20*b* of the coupling element advantageously provides for tubing section 12*b* to extend parallel to and closely adjacent top side 14 of the cartridge, thus to provide a low profile for the connection. It will be appreciated that the interengagement between tubing 12 and openings 32 and 34 in handle 18 restrains any displacement of the tubing downwardly relative to the handle in response, for example, to the application of a downward force on the tubing from a location below the handle. While it is preferred to provide an L-shaped coupling for connecting the tubing with ink chamber C, it will be appreciated that other coupling configurations can be used and that the tubing can be directly connected with the ink chamber such as by extending through an opening in the top of the cartridge. In the latter instance, the tubing would be adhesively bonded or otherwise sealed relative to the cartridge against the leakage of ink from the chamber.

Figure 3:
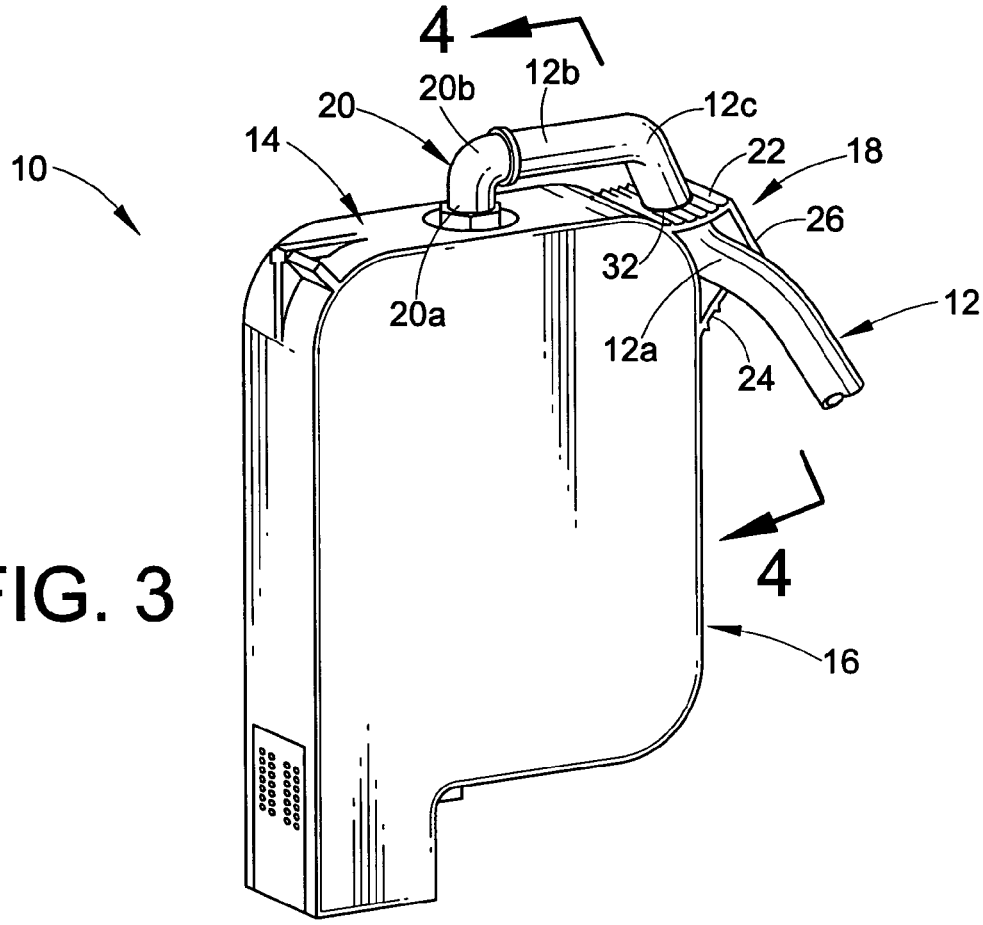
FIG. 3 is a perspective view of an ink jet cartridge having another strain relief arrangement for the ink supply tubing connected thereto; and, FIG. 4 is an enlarged cross-sectional view of the strain relief arrangement taken along line 4—4 in FIG. 3.
Figure 4:
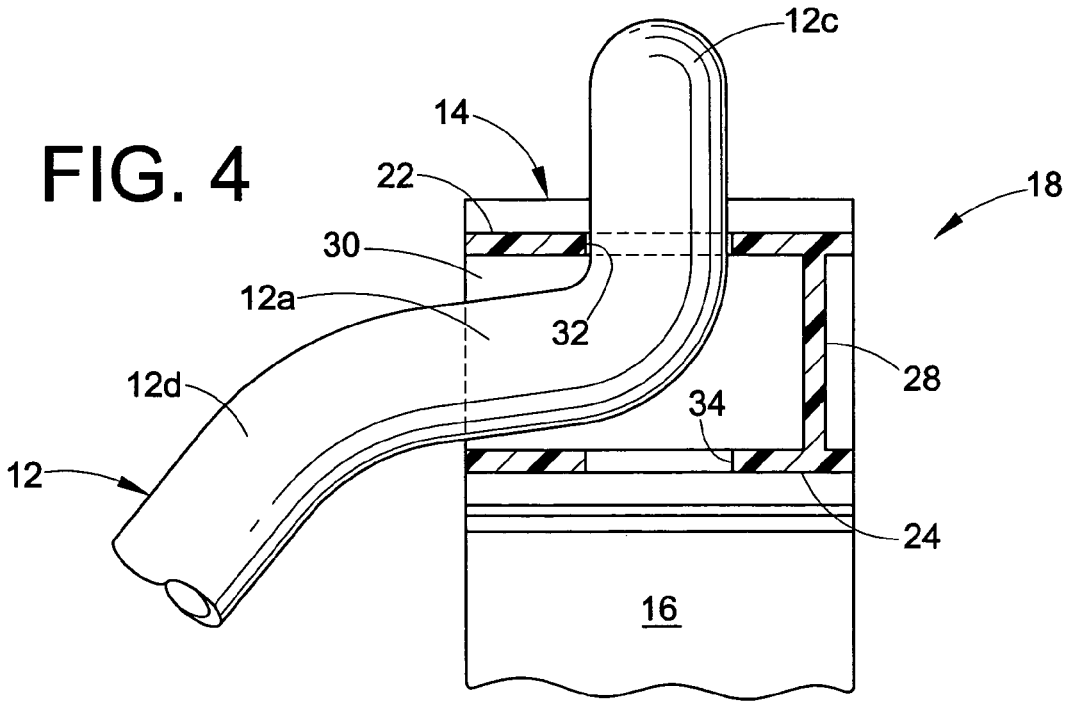

FIGS. 3 and 4 illustrate a modification of the strain relief arrangement shown in FIGS. 1 and 2. The modification involves a different routing of tubing 12 relative to handle 18 and does not necessarily require a modification of the cartridge and handle structure shown in FIGS. 1 and 2. Accordingly, the same numerals and characters are used in the drawings of both embodiments. In the embodiment of FIGS. 3 and 4, section 12*a* of tubing 12 is routed downwardly through opening 32 in top wall 22 of the handle and thence outwardly through open side 30 of the handle. This routing provides a second, somewhat S-shaped, bend in section 12*a* between bend 12*c* and the section 12*d* of the tubing outwardly adjacent open end 30 of the handle. The second bend further restrains displacement of tubing 12 relative to the handle in a manner which would apply a pulling force to the tubing at the connection thereof with coupling 20. It will be appreciated, of course, that opening 34 in bottom wall 24 of the handle is not necessary in connection with this routing. At the same time, however, opening 34 provides a user with the option of choosing the one of the two possible routings which might be preferred in a particular printer environment. Further, while handle 18 in the embodiments disclosed herein has an open side 30, it will be appreciated that an opening for the tubing could be provided in wall 28 at the closed side of the handle should it be desired to route the tubing in the latter direction.

While considerable emphasis has been placed herein on the structures of the preferred embodiments illustrated and described, it will be appreciated that other embodiments can be devised and that more applications can be made in the preferred embodiments without departing from the principals of the invention. Accordingly, it is to be distinctly understood that the foregoing descriptive matter is to be interpreted merely as illustrative of the invention, and not as a limitation and that it is intended to include other embodiments and all modifications of the preferred embodiments insofar as they come within the scope of the appended claims or the equivalents thereof.

Having thus described the invention, it is so claimed:

1. An ink jet cartridge for use in a continuous cartridge refill system, said cartridge comprising a bottom side, a rear side, an ink cartridge print head at the juncture between said bottom side and said rear side, a top side, a front side and a handle at the juncture between said top side and said front side, said top side including an ink inlet for connection with a flexible ink supply tube, and said handle including a strain relief opening through which the tube extends for connection with said inlet.

2. An ink jet cartridge according to claim 1, wherein said handle includes a top wall and a bottom wall therebelow, said strain relief opening being through said top and bottom walls.

3. An ink jet cartridge according to claim 2, further including a tube coupling on said top side having a leg parallel to said top side and facing said handle to receive the supply tube.

4. An ink jet cartridge according to claim 2, wherein said handle has laterally opposite sides and said opening is between said sides.

5. An ink jet cartridge according to claim 4, including a tube coupling on said top side having a leg parallel to said top side and facing said handle to receive the supply tube.

6. An ink jet cartridge for use in a continuous cartridge refill system, said cartridge comprising a top side, a front side and a handle at the juncture between said top side and said front side, said top side including an ink inlet for connection with a flexible ink supply tube, and said handle including a strain relief opening through which the tube extends for connection with said inlet, wherein said handle includes top and bottom walls and laterally opposite sides, said strain relief opening being through said top wall and one of said sides.

7. An ink jet cartridge according to claim 6, wherein the opening in said top wall is between said sides.

8. An ink jet cartridge according to claim 6, further including a tube coupling on said top side having a leg parallel to said top side and facing said handle to receive the supply tube.

9. An ink jet cartridge according to claim 8, wherein the opening in said top wall is centrally between said sides.

10. An ink jet cartridge for use in a contiguous cartridge refill system, said cartridge comprising a top side, a front side and a handle at the juncture between said top side and said front side, said top side including an ink inlet for connection with a flexible ink supply tube, and said handle including a strain relief opening through which the tube extends for connection with said inlet, wherein said handle includes a top wall and a bottom wall therebelow, said strain relief opening being through said top and bottom walls.

11. An ink jet cartridge according to claim 10, further including a tube coupling on said top side having a leg parallel to said top side and facing said handle to receive the supply tube.

* * * * *